US010139172B2

(12) United States Patent
Hunt et al.

(10) Patent No.: US 10,139,172 B2
(45) Date of Patent: Nov. 27, 2018

(54) HEAT EXCHANGER FIN RETENTION FEATURE

(71) Applicant: MAHLE International GmbH, Stuttgart (DE)

(72) Inventors: Terry J. Hunt, Williamsville, NY (US); Thomas A. Bowler, Lockport, NY (US); Grzegorz Kaczowka, Williamsville, NY (US)

(73) Assignee: MAHLE International GmbH, Stuttgart (DE)

( * ) Notice: Subject to any disclaimer, the term of this patent is extended or adjusted under 35 U.S.C. 154(b) by 360 days.

(21) Appl. No.: 14/471,423

(22) Filed: Aug. 28, 2014

(65) Prior Publication Data

US 2016/0061537 A1 Mar. 3, 2016

(51) Int. Cl.

| | |
|---|---|
| ***F28F 9/22*** | (2006.01) |
| ***F28F 3/02*** | (2006.01) |
| ***F28F 1/12*** | (2006.01) |

(52) U.S. Cl.

CPC ..... *F28F 3/025* (2013.01); *F28F 1/128* (2013.01)

(58) Field of Classification Search

CPC .. F28F 3/025; F28F 1/126; F28F 1/325; F28F 1/128; F28F 1/42; H01L 2924/0002; H01L 2924/00; H01L 23/4093; H01L 23/3672; F28D 1/05366; F28D 1/0391; Y10T 29/49391; Y10T 29/4935; Y10T 29/49378; Y10T 29/4938; B23P 15/26; B23K 1/0012; B23K 1/0014; B23K 2201/12; B23K 2201/14; C10G 9/203

See application file for complete search history.

(56) References Cited

U.S. PATENT DOCUMENTS 1,950,500 A * 3/1934 Loprich ..... F28F 1/126 165/152
3,003,749 A * 10/1961 Morse ..... F28F 1/128 165/152

(Continued)

FOREIGN PATENT DOCUMENTS

DE 4026988 A1 * 2/1992 ..... F28D 1/0391
DE 19808202 A1 * 9/1999 ..... F28D 1/0435
GB 1 295 288 11/1972

OTHER PUBLICATIONS

English Translation of DE19808202.*
https://www.wikipedia.org/ Wikipedia Deformation (Engineering) Accessed: Mar. 27, 2018.*

*Primary Examiner* — Ned Landrum
*Assistant Examiner* — Melodee Jefferson
(74) *Attorney, Agent, or Firm* — Brinks Gilson & Lione

(57) ABSTRACT

A fin characterized by a corrugated shape and configured to be interposed between adjacent instances of tubes of a heat exchanger assembly includes a plurality of planar portions, a radiused portion, and a retention feature. The plurality of planar portions is configured to extend between the adjacent instances of the tubes. The radiused portion is located between adjacent planar portions and is configured to be in thermal contact with a tube proximate thereto. The retention feature is located substantially mid-way between a leading edge and a trailing edge of the fin. The retention feature is configured to contact the tube in a manner effective to prevent fall-out of the fin prior to brazing of the heat exchanger assembly.

5 Claims, 4 Drawing Sheets

(56) References Cited

U.S. PATENT DOCUMENTS 3,265,127 A * 8/1966 Nickol ..... F28F 1/128 165/152
3,266,567 A * 8/1966 Kinal ..... F28F 1/32 165/151
3,422,777 A 1/1969 Plegat
3,537,517 A * 11/1970 Doyle ..... F28F 1/30 165/182
4,034,453 A * 7/1977 Tomita ..... B21D 53/02 29/890.047
4,067,219 A * 1/1978 Bianchi ..... B21D 13/04 72/186
4,086,959 A * 5/1978 Habdas ..... F28F 1/42 165/141
4,311,193 A * 1/1982 Verhaeghe ..... F28F 1/128 165/149
4,535,839 A * 8/1985 Sacca ..... F28D 1/0333 165/153
4,538,677 A * 9/1985 Bodas ..... F28F 1/36 165/146
4,676,304 A * 6/1987 Koisuka ..... F28D 1/0478 165/146
5,056,586 A * 10/1991 Bemisderfer ..... F28F 1/128 165/109.1
5,183,629 A * 2/1993 Canat ..... G21C 3/322 376/438
5,271,458 A * 12/1993 Yamamoto ..... F28F 1/128 165/152
5,386,629 A * 2/1995 Ouchi ..... F28D 1/0316 29/890.043
5,390,731 A * 2/1995 Selm ..... F28F 1/128 165/152
5,505,257 A * 4/1996 Goetz, Jr. ..... F28F 1/126 165/152
5,558,155 A * 9/1996 Ito ..... B23K 1/0012 165/185
5,617,737 A * 4/1997 Christensen ..... B01D 1/02 62/487
5,669,438 A * 9/1997 Beales ..... F28F 1/128 165/152
5,738,169 A * 4/1998 Stoynoff ..... B21D 31/043 165/151
5,765,634 A * 6/1998 Martins ..... F28D 1/0391 165/177
5,787,972 A * 8/1998 Beamer ..... F28F 1/128 165/152
5,867,904 A * 2/1999 Harris ..... B23P 15/26 29/890.046
6,247,527 B1 * 6/2001 Paulman ..... F28F 1/128 165/152
6,397,939 B1 * 6/2002 Swiger ..... F28D 1/05383 165/153
6,439,300 B1 * 8/2002 Falta ..... F25B 39/02 165/152
6,494,254 B2 * 12/2002 Laveran ..... B21C 37/08 165/133
6,662,615 B2 12/2003 Hunt
6,799,630 B1 * 10/2004 Kato ..... B23K 1/0012 165/170
6,874,345 B2 * 4/2005 Stoynoff, Jr. ..... B21D 31/046 72/186
7,913,750 B2 3/2011 Huang et al.
8,881,797 B2 * 11/2014 Melo ..... F28D 9/0062 165/166
2002/0195235 A1 * 12/2002 Falta ..... F25B 39/02 165/152
2006/0175047 A1 * 8/2006 Hattori ..... B21D 53/085 165/133
2008/0302131 A1 * 12/2008 Higashiyama ..... F25B 39/02 62/515
2009/0025916 A1 * 1/2009 Meshenky ..... B21D 13/08 165/151
2009/0242180 A1 * 10/2009 Gonzales ..... B21C 37/151 165/153
2015/0034289 A1 * 2/2015 Seo ..... F28F 1/12 165/173

* cited by examiner

HEAT EXCHANGER FIN RETENTION FEATURE

TECHNICAL FIELD OF INVENTION

This disclosure generally relates to a fin for a heat exchanger assembly, and more particularly relates to a retention feature in the middle of the fin configured to engage with a tube to prevent fall-out of the fin prior to brazing of the heat exchanger.

BACKGROUND OF INVENTION

Heat exchangers such as radiators, evaporators, and condensers are commonly formed by an arrangement of alternating tubes and corrugated fins. A known method of manufacturing such heat exchangers places the tubes and fins in a stacker that pressed the arrangement to a desired dimension, and then subjects the arrangement to a brazing process. If not adequately retained, a fin can undesirable drop below the bottom face of the heat exchanger during the brazing process.

SUMMARY OF THE INVENTION

In accordance with one embodiment, a fin characterized by a corrugated shape configured to be interposed between adjacent instances of tubes of a heat exchanger assembly is provided. The fin includes a plurality of planar portions, a radiused portion, and a retention feature. The plurality of planar portions is configured to extend between the adjacent instances of the tubes. The radiused portion is located between adjacent planar portions and is configured to be in thermal contact with a tube proximate thereto. The retention feature is located substantially mid-way between a leading edge and a trailing edge of the fin. The retention feature is configured to contact the tube in a manner effective to prevent fall-out of the fin prior to brazing of the heat exchanger assembly.

In another embodiment, a heat exchanger assembly is provided. The assembly includes a plurality of parallel spaced apart tubes, and a fin. The tubes are configured to convey coolant therethrough. The fin is characterized by a corrugated shape and is interposed between adjacent instances of the tubes. The fin defines a plurality of planar portions configured to extend between the adjacent instances of the tubes. Each planer portion is joined to an adjacent planer portion by a radiused portion that is in thermal contact with a tube proximate thereto. The radiused portion includes a retention feature located substantially mid-way between a leading edge and a trailing edge of the fin. The retention feature is configured to contact the tube in a manner effective to prevent fall-out of the fin prior to brazing of the heat exchanger assembly.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION

Figure 1:
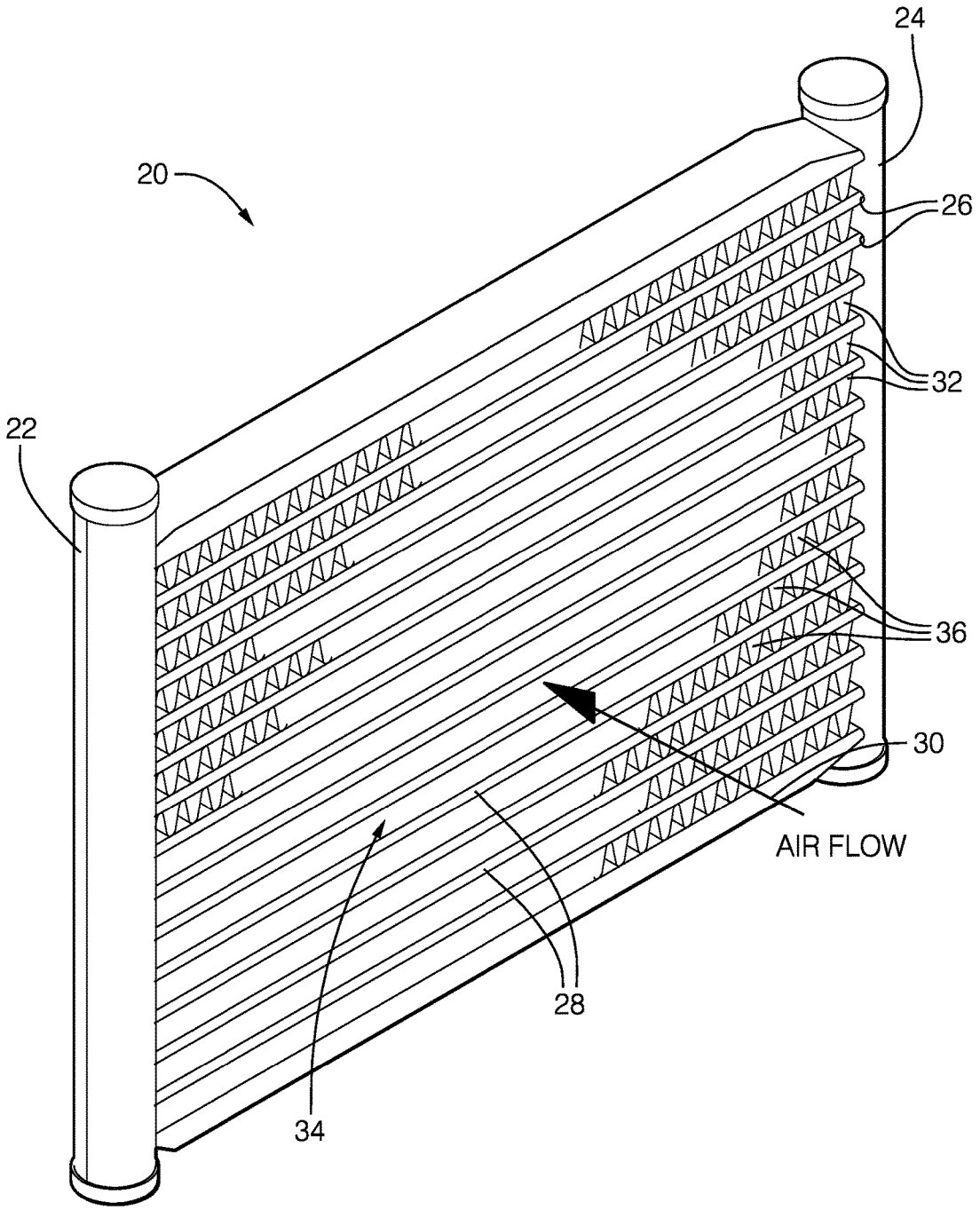
FIG. 1 is a perspective front view of a heat exchanger assembly equipped with fins in accordance with one embodiment.

FIG. 1 illustrates a non-limiting example of a heat exchanger assembly, hereafter referred to as the assembly 20. The assembly 20 includes a first manifold 22 and a second manifold 24 spaced apart from and in a substantially parallel relationship with the first manifold 22. The first manifold 22 and the second manifold 24 are configured to receive a plurality of parallel spaced apart tubes 28 configured to convey, for example, coolant through the tubes 28 between the first manifold 22, and the second manifold 24. The tubes 28 are typically inserted into slots 26 of the first manifold 22 and the second manifold 24 and sealed to the manifolds by, for example, brazing, as will be recognized by those in the art. A plurality of corrugated fins, hereafter the fin 32, is disposed between and in thermal contact with adjacent instances of the tubes 28 for increased heat transfer efficiency between the fluid in the tubes 28 and the airflow 30 through the assembly 20, which may be urged by a fan (not shown). The tubes 28 and the fin 32 between the tubes 28 generally cooperate to define a core 34 of the assembly 20. Spaces between adjacent planar portions of the fin 32 and the tubes 28 cooperate to define a plurality of channels 36 that direct the airflow 30 through the core 34.

Figure 2A:
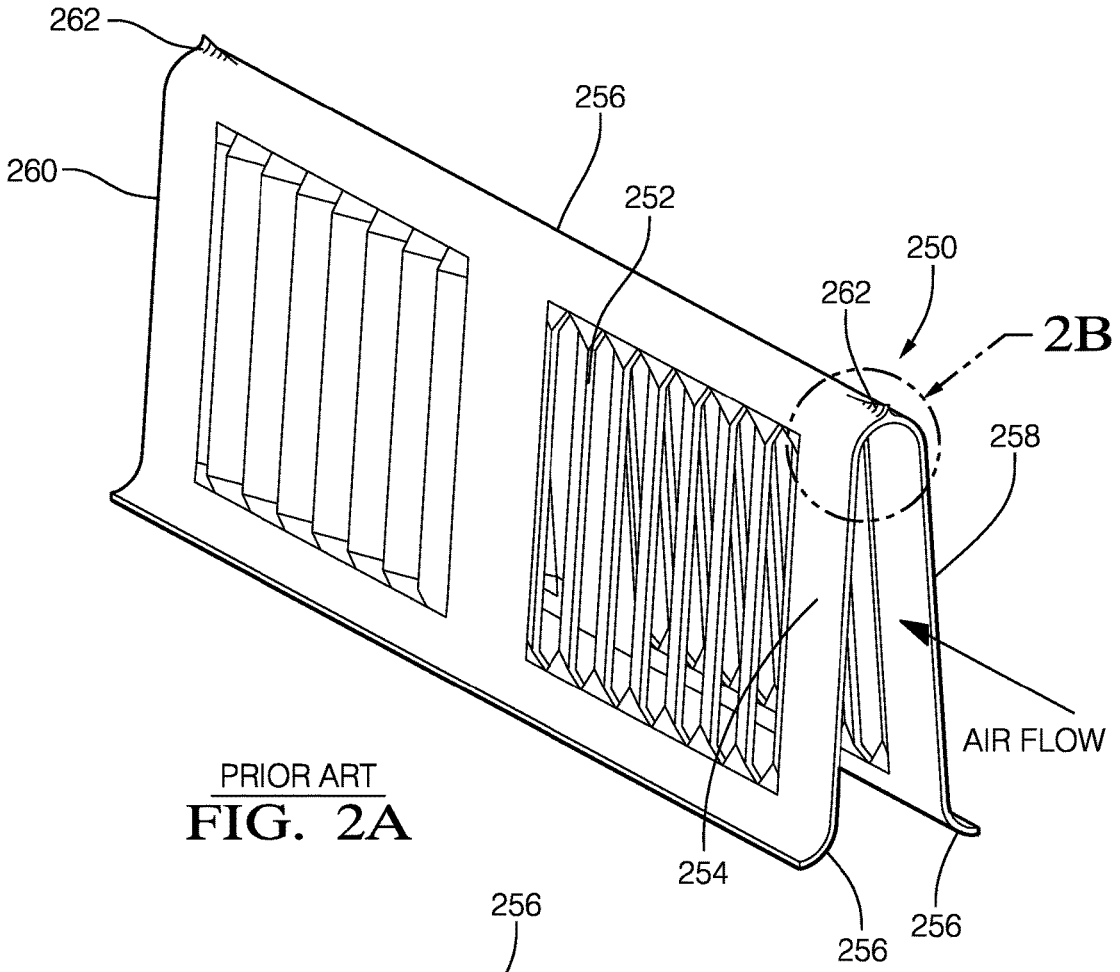
PRIOR ART FIG. 2A
FIGS. 2A and 2B are perspective views of a known fin.
Figure 2B:
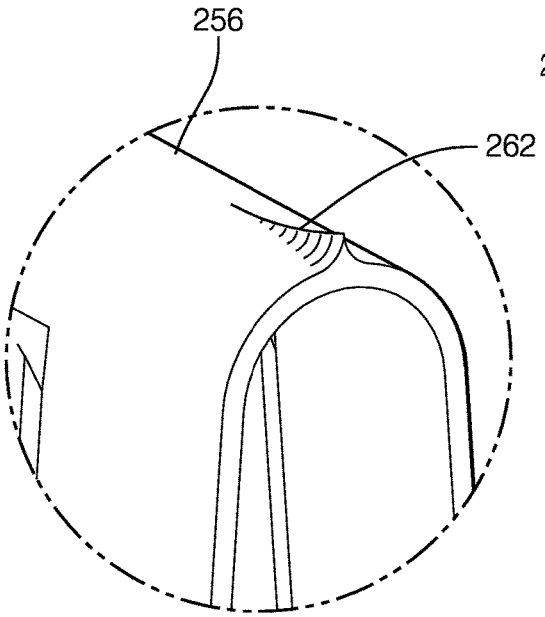
PRIOR ART FIG. 2B

FIGS. 2A and 2B illustrate a portion of a prior art corrugated fin, hereafter the known fin 250. The known fin 250 is formed from a thin strip of heat conductive material such as aluminum. The shape of the known fin 250 includes radiused portions 256 and planar portions 254 that are alternately continuously arranged to define a corrugation. Each of the planar portions 254 includes a leading edge 258 oriented into the oncoming direction of the airflow 30, a trailing edge 260 spaced and opposite from the leading edge 258, and a plurality of louvers 252 therebetween. A known means to hold the known fin 250 in position during the brazing process was to form a raised lip 262 on both ends (e.g. the leading edge 258 and the trailing edge) of the radiused portion 256. The height of the raised lip 262 is selected to contact the tubes such that the known fin 250 stays in place during the brazing process. If the radiused lip 262 is too high, the material used for the known fin 250 may tear. If the radiused lip 262 is too low, the known fin 250 may drop during brazing. Another problem occurs if a known fin 250 is not precisely centered on the adjacent tube. When this happens, the leading or trailing edge of the known fin 250 can be distorted giving the edge an undesirable 'candy ribbon' appearance.

Referring again to FIG. 1, the heat exchanger assembly (the assembly 20) includes a plurality of parallel spaced apart tubes (the tubes 28) configured to convey, for example, coolant, refrigerant, oil, or other suitable fluid through the tubes 28. The fin 32 is characterized by a corrugated shape and the fin 32 is interposed between adjacent instances of the tubes 28.

FIGS. 3A, 3B, 4A, and 4B illustrate non-limiting details of one embodiment to the fin 32. In general, the fin 32 defines a plurality of planar portions 40 configured to extend between adjacent instances of the tubes 28 (see FIG. 1) when the fin 32 is part of the assembly 20. Each planer portion 40 is joined to an adjacent planer portion by a radiused portion 42. The radiused portion 42 is in thermal contact with a tube when the fin 32 is part of the assembly 20. In order to maintain the position of the fin 32 relative to the tube 28 after the fins and tubes have been stacked in an alternating arrangement but before brazing, the radiused portion includes a retention feature 44 located substantially mid-way between a leading edge 46 and a trailing edge 48 of the fin 32. As used herein, mid-way between the leading edge 46 and the trailing edge 48 means that the retention feature is far enough away from the leading edge 46 and the trailing edge 48 so that the undesirable 'candy ribbon' affect is not imparted onto the planar portion 40 at the leading edge 46 and the trailing edge 48. That is, if there is any distortion of the planar portion 40 caused by the stack of fins and tubes being pressed together prior to brazing, the distortion is far enough away from the leading edge 46 and the trailing edge 48 that the distortion is hidden from view by casual inspection of the assembly 20. In general, the retention feature 44 is configured to contact the tube 28 (see FIG. 1) in a manner effective to prevent fall-out of the fin 32 from a stack of fins and tubes prior to brazing of the assembly 20.

Figure 3A:
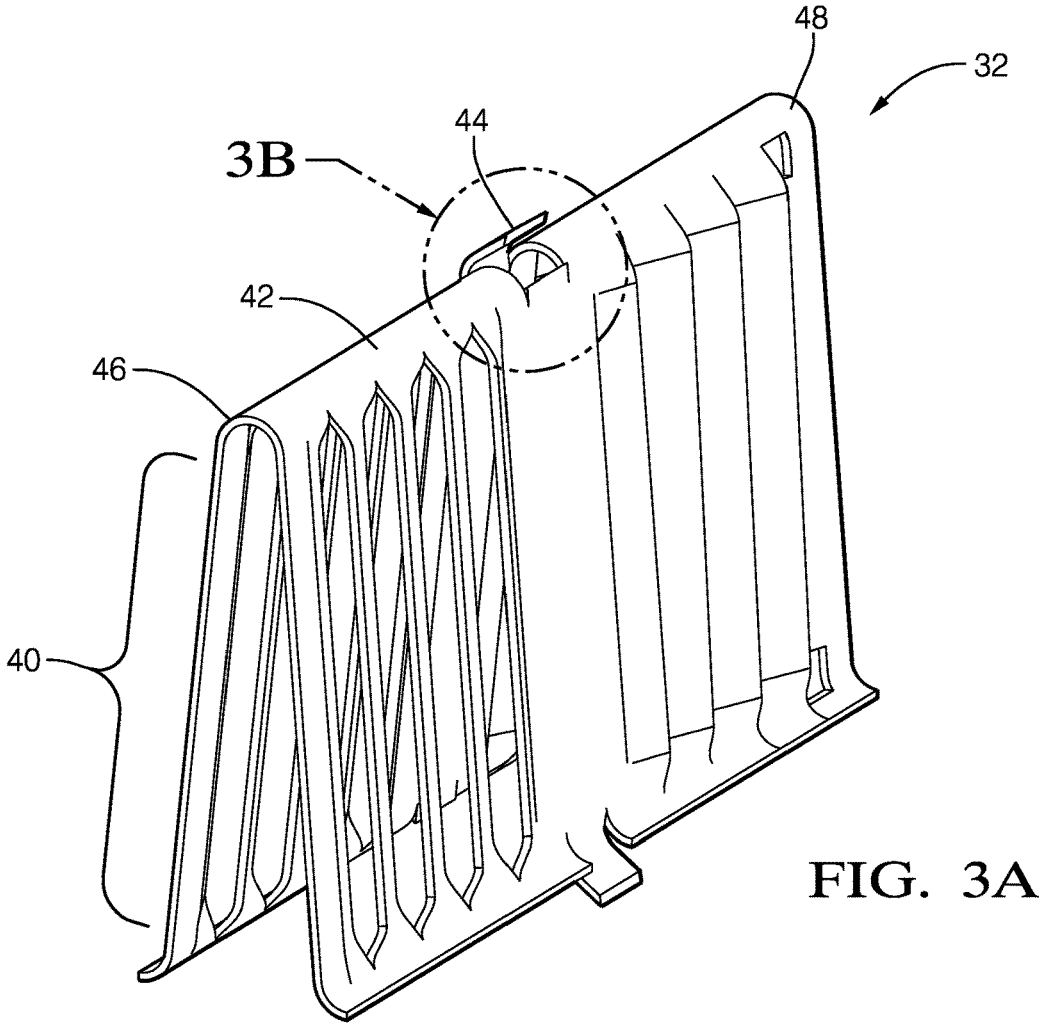
FIGS. 3A and 3B are perspective views of a fin of the assembly of FIG. 1 in accordance with one embodiment.
Figure 3B:
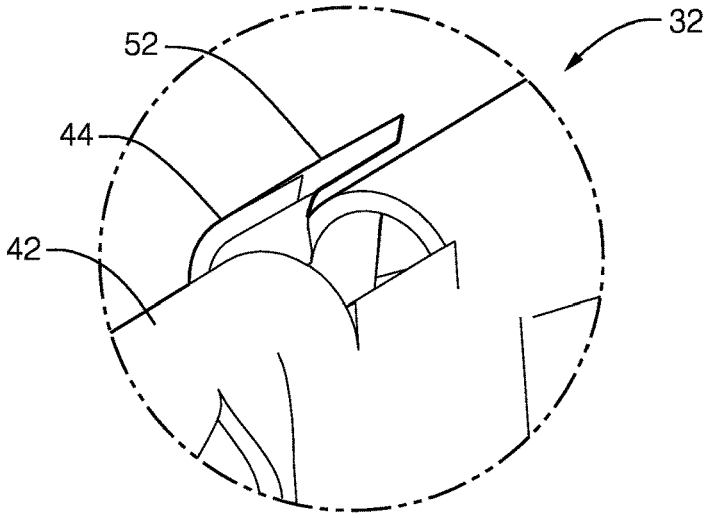

FIGS. 3A and 3B shows a non-limiting example of the retention feature 44 that includes a sharp edge 52 configured to deform to make an engaged contact with the tube 28 when the arrangement of tubes and fins are pressed together prior to brazing. As used herein, an engaged contact means that there is an intent to gouge or scratch the tube 28 by the sharp edge 52 so that the sharp edge 52 is not easily moved relative to the tube 28, but not so much that the tube is damaged and, for example, at risk of developing a leak. The use of the sharp edge to make an engaged contact is generally preferable when the tubes are constructed in such a way as to not be significantly damaged or deformed by deflection of the sharp edge 52 during assembly.

Figure 4A:
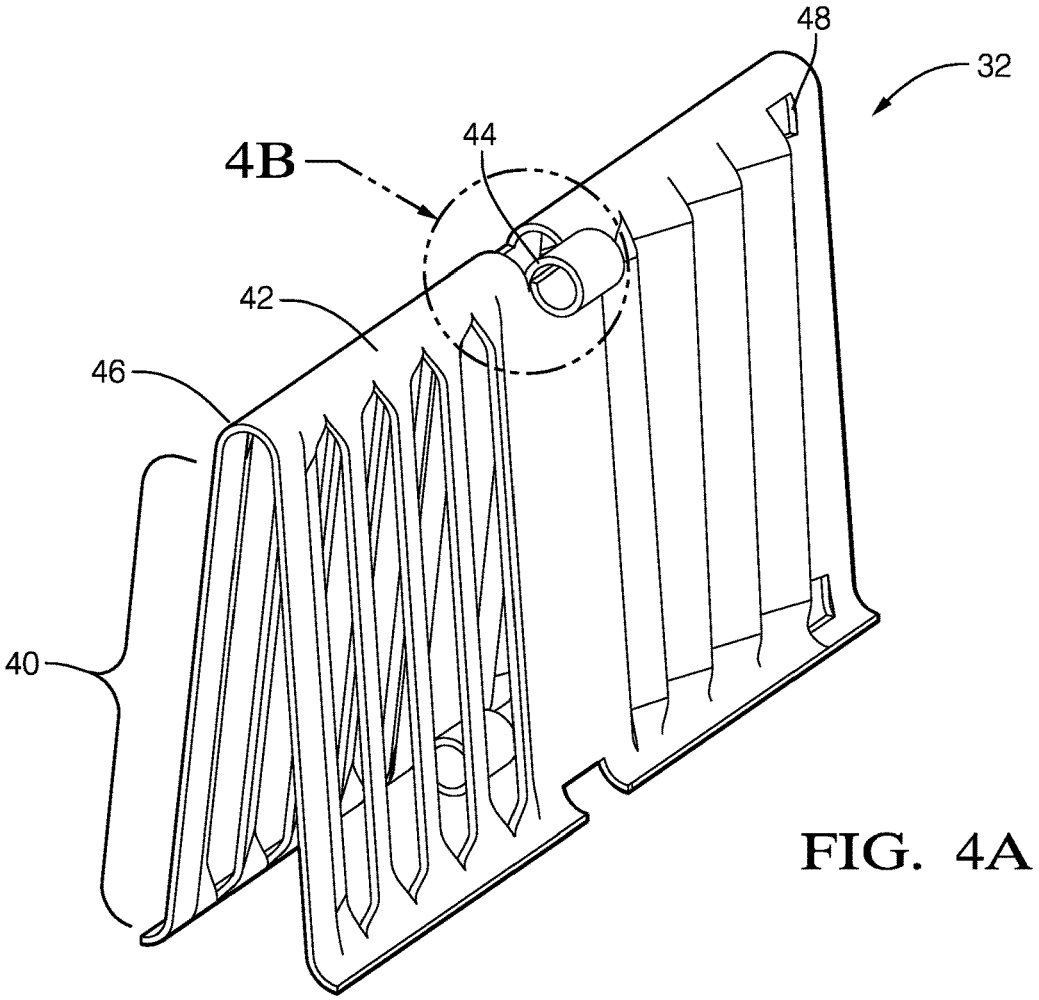
FIGS. 4A and 4B are perspective views of a fin of the assembly of FIG. 1 in accordance with one embodiment.
Figure 4B:
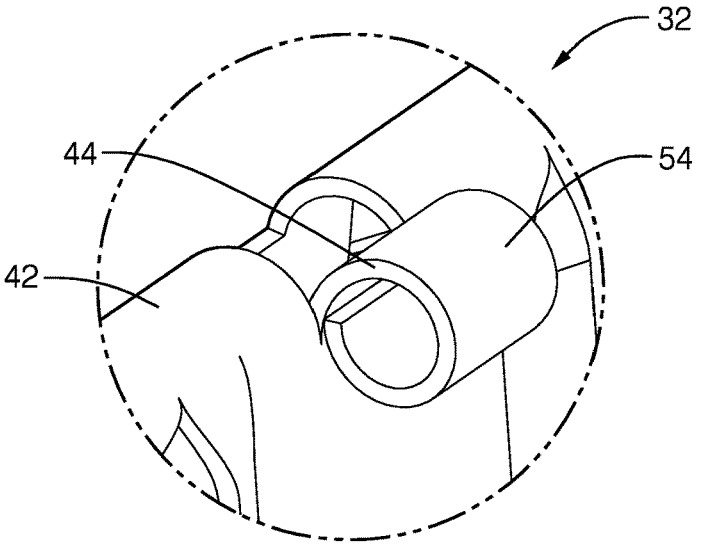

FIGS. 4A and 4B shows an alternative non-limiting example of the retention feature 44 that includes a coil portion 54 configured to deform to make a spring-biased contact with the tube 28. As used herein, a spring-biased contact means that the retention feature 44 is intended to not cause a substantial alteration to the contacting surface of the tube. A spring-biased contact may be preferable if the tube is relatively delicate and easily damaged. The coil portion 54 spreads any contact force applied against the tube by providing a greater contact area when compared to the sharp edge 52, and by more readily deflecting.

While the examples set forth herein show a single retention feature on each radiused portion, multiple retention features are contemplated. Furthermore, other shapes of retention features are contemplate such as a sharp edge provided by a 'birds-mouth' feature formed by piercing the radiused portion, or an S-shaped coil portion.

Advantages of the fin 32 described herein include: (1) reduces cosmetic damage on the outside face of the heat exchanger caused by the candy ribbon effect on the edges (leading or trailing) of the fin 32, (2) reduces the need to limit the height of the raised portion to within the elasticity limits of the material, (3) reduces the sensitivity of the relative position between the tube 28 and fin 32, and (4) the retention feature is controllably collapsible to create a secure fit between the tube and fin that holds its position during the cooling and heating cycles of the brazing process.

The retention feature 44 may be formed within a form roll station. The traditional stripper discs in the middle position of the form roll assembly may be replaced with a neutral form disc that will have a larger diameter than the adjacent discs next to it. As the form rolls are driven, the engagement of the neutral form disc at the larger diameter will pierce through the material as it rolls through its mating discs root diameter. The material as it is pierced will curl back thus protruding above the radiused portion 42. The collapsible raised middle margin created by a retention feature 44 on the top and bottom radiused portions creates the interference required with the tube during the stacking process to hold the fin in position during the brazing process.

When the assembly 20 is assembled, the fins and tubes are arranged in an alternating manner. Once completed, an operator activates the core assembly machine to "squeeze" the fin and tube arrangement to a final set dimension to allow the headers to be placed onto the heat exchanger assembly. When squeezed, the retention feature 44 collapses on itself to create interference between the tube and the fin effective to hold the fin in position during the brazing process.

The fin 32 described herein improves the present manufacturing process by: (1) eliminates the need to minimize the height of the raised margin as the retention feature if formed by piercing the material of the fin; (2) eliminates the candy ribbon cosmetic effect of the fin at the core face since any collapsing of the fin is internal to the heat exchanger assembly and visually unnoticeable; (3) eliminates the exact position requirements of the fin relative to the tube to eliminate the candy ribbon effect as the collapsible middle margin formed by the retention feature 44 can shift position on the tube internally to the core and not create cosmetic damage; and (4) the material collapsing on itself creates a solid interference between the tube and fin to allow it to hold its position during the brazing process.

Accordingly, a heat exchanger assembly (the assembly 20) and a fin 32 for the assembly 20 is provided. The retention feature 44 deforms or collapses during the stacking process to create a "material jam" between the fin and tube to hold the center in position during the braze process. Having retention feature 44 located about mid-way on the fin 32 is advantageous if the internal convolutions or louvers buckle during the stacking process it is unnoticeable on the face of the core as not to create a visual quality defect. The fin 32 being held in position by the retention feature 44 eliminates dropped fins in the brazing process. The tooling to create the retention feature 44 can be used with either flush face cores or offset cores. The retention feature 44 can be used with both welded and extruded tubes, and can be adapted to prevent damage to delicate tubes. Moving the anti-drop feature (e.g. the retention feature 44) from the outside edge of the fin (e.g. the raised lip 262) to the internal portion of the fin eliminates a source of visual quality defects.

While this invention has been described in terms of the preferred embodiments thereof, it is not intended to be so limited, but rather only to the extent set forth in the claims that follow.

We claim:

1. A fin characterized by a corrugated shape configured to be interposed between adjacent instances of tubes of a heat exchanger assembly, said fin comprising:

a plurality of planar portions configured to extend between the adjacent instances of the tubes;

a radiused portion located between adjacent planar portions and configured to be in thermal contact with a tube proximate thereto; and a retention feature located between a leading edge and a trailing edge of the fin and remote from both the leading edge and the trailing edge, said retention feature configured to contact the tube in a manner effective to prevent fall-out of the fin prior to brazing of the heat exchanger assembly, wherein the retention feature includes a curled coil portion forming a loop protruding from the radiused portion and configured to deform to make a spring-biased contact with the tube and to spread a contact force over a contact area of the tube, wherein the curled coil portion is curling away from the radiused portion.

2. The fin according to claim 1, wherein the retention feature is pierced out of the fin and curled back such that it protrudes outward from the radiused portion.

3. The fin according to claim 1, wherein the curled coil portion is offset from the radiused portion away from one of the adjacent planar portions toward the other one of the adjacent planar portions.

4. A heat exchanger assembly, said assembly comprising: a plurality of parallel spaced apart tubes configured to convey coolant therethrough; and a fin characterized by a corrugated shape interposed between adjacent instances of the tubes, wherein the fin defines a plurality of planar portions extending between the adjacent instances of the tubes, each planar portion joined to an adjacent planar portion by a radiused portion in thermal contact with a proximate one of the tubes, wherein the radiused portion includes a retention feature located between a leading edge and a trailing edge of the fin and remote from both the leading edge and the trailing edge, said retention feature being pierced out of the radiused portion, protruding outward from the radiused portion, and contacting the proximate tube in a manner effective to prevent fall-out of the fin prior to brazing of the heat exchanger assembly, wherein the retention feature includes a coil portion forming a loop configured to deform to make a spring-biased contact with the tube, wherein the coil portion is curling away from the radiused portion.

5. The fin according to claim 4, wherein the coil portion is offset from the radiused portion away from one of the adjacent planar portions toward the other one of the adjacent planar portions.

* * * * *